US011944882B1

(12) United States Patent
Reis

(10) Patent No.: US 11,944,882 B1
(45) Date of Patent: Apr. 2, 2024

(54) MULTISPORT TARGETING DEVICE AND SYSTEM

(71) Applicant: Antonio Augusto Ribeiro Reis, Los Angeles, CA (US)

(72) Inventor: Antonio Augusto Ribeiro Reis, Los Angeles, CA (US)

( * ) Notice: Subject to any disclaimer, the term of this patent is extended or adjusted under 35 U.S.C. 154(b) by 306 days.

(21) Appl. No.: 17/643,752

(22) Filed: Dec. 10, 2021

Related U.S. Application Data

(63) Continuation-in-part of application No. 16/722,666, filed on Dec. 20, 2019, now Pat. No. 11,198,046.

(60) Provisional application No. 62/782,655, filed on Dec. 20, 2018.

(51) Int. Cl.
*A63B 63/00* (2006.01)
*A63B 71/06* (2006.01)

(52) U.S. Cl.
CPC ..... *A63B 63/004* (2013.01); *A63B 71/06* (2013.01); *A63B 2063/002* (2013.01); *A63B 2209/02* (2013.01); *A63B 2220/806* (2013.01); *A63B 2225/50* (2013.01)

(58) Field of Classification Search
CPC . A63B 63/004; A63B 71/06; A63B 2063/002; A63B 2209/02; A63B 2220/806; A63B 2225/50
USPC ..... 463/7
See application file for complete search history.

(56) References Cited

U.S. PATENT DOCUMENTS

| | | | | |
|---|---|---|---|---|
| 5,280,919 | A | 1/1994 | Graham | |
| 7,134,976 | B1 | 11/2006 | Smith | |
| 7,661,679 | B2 | 2/2010 | Mah et al. | |
| 8,109,845 | B2 | 2/2012 | Duty | |
| 9,266,003 | B2 * | 2/2016 | Luo | A63B 69/3623 |
| 2006/0033284 | A1 | 2/2006 | Birss | |
| 2013/0215324 | A1 | 8/2013 | Manning | |

OTHER PUBLICATIONS

Notice of Allowance for U.S. Appl. No. 16/722,666, dated Jul. 8, 2021, 8 pages.

* cited by examiner

*Primary Examiner* — Allen Chan
(74) *Attorney, Agent, or Firm* — BUCHALTER

(57) ABSTRACT

A targeting device includes a body (504) that is formed from a flexible polymeric material with opposing sides with a target coupler (506) about one opposing side of the body (504). A goal frame coupler (502) is carried from body (504) and is formed with a surface that may be received with a friction pad (514). Also contemplated is at least one strap-type adjusting device (508) that is carried by the goal frame coupler and/or the body, and which is formed with at least one knob that cooperates with the goal frame coupler to fasten the targeting device to a pole or other structure. In variations, at least one respective channel (516) is formed in the coupler (502) and sized to capture one or more of the adjustment knobs. The target coupler (506) may be formed by a connection joint (518), which is coupled to a target (510) there about.

20 Claims, 7 Drawing Sheets

MULTISPORT TARGETING DEVICE AND SYSTEM

CROSS REFERENCE TO RELATED APPLICATIONS

The present application claims the benefit under 35 U.S.C. § 120 to U.S. Patent Application Nos. 62/782,655, filed Dec. 20, 2018, and 16-722,666 filed Dec. 20, 2019 and granted as U.S. Pat. No. 11,198,046, which are both entitled "MULTISPORT TARGETING DEVICE AND SYSTEM", and which applications are incorporated by reference herein in their entirety.

FIELD OF TECHNOLOGY

Aspects of the present disclosure generally relate to targeting devices, and more particularly to a multisport targeting device and system.

BACKGROUND

Sports are an everyday part of life. People from every country, and every walk of life, participate in various sporting pastimes. Many people play sports, e.g., football (also referred to as "soccer" in some countries), baseball, cricket, etc., as a competitive and/or semi-competitive pastime, in leagues and/or as traveling teams that participate in tournaments in various geographic areas.

Some people are fortunate enough to play sports as their profession. Many hours of training, drills, and competition may be undertaken by professional athletes to excel at their chosen sports. American football players may practice plays for hours, days, and even weeks, before such a play is ever used in a league game. Baseball players may practice situational plays to determine what to do should such a situation arise in a competitive game. Football (soccer) players may practice passing the ball through obstacles, designing corner kicks and/or free kicks to increase their opportunity, and/or soccer goalkeepers may practice defending against penalty kicks, all in preparation for game situations.

Many sports, such as American football, soccer, baseball, etc., require multiple people to practice various techniques. For example, throwing a pass in American football requires a person to throw the football and another person to catch the football; throwing a football to an open spot is not necessarily representative of a game situation.

Further, because many sports have specialized personnel to perform various tasks, e.g., pitchers in baseball, placekickers in American football, designated players to take corner kicks and/or free kicks in soccer, etc., it may be difficult to assemble the required additional personnel desired to simulate a game-style scenario. For example, and not by way of limitation, it may be difficult to find a person to take penalty kicks so a goalkeeper can practice penalty kick scenarios.

Feedback for such practice may also be difficult to assess. Kicking twenty penalty kicks or corner kicks that are not all perfectly placed leaves a player little feedback other than missed location and/or missed placement of the ball. There may be no coach or other player present during the practice session to see what, if anything, changed between successful and/or unsuccessful attempts.

SUMMARY

Aspects of the disclosure include devices, systems and methods for providing information to sports participants regarding hitting targets, achieving greater accuracy, and improving skill levels. Such information may include, for example, video information, directional information, and/or real-time updated information that may provide feedback to players for improving their skill at one or more tasks that may be performed during competition.

A device in accordance with an aspect of the present disclosure comprises a body, a coupler, coupled to a first portion of the body, a target coupler, coupled to a second portion of the body, an adjusting device coupled to the body for enabling movement of at least one of the coupler and the target coupler, and a target, coupled to the target coupler.

Such a device further optionally includes an adjustable size of the target the coupler enabling coupling of the targeting device to a goalframe, the body and the adjusting device enabling a fixed orientation between the coupler and the target coupler, a net, coupled to the target, at least one visual aid coupled to the target, at least one sensor, coupled to the target, for determining accuracy of an attempt to hit the target, a processor, coupled to the at least one sensor, for recording signals from the at least one sensor, the processor being communicatively coupled to a cellular telephone system, and the at least one sensor comprising a camera.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The present disclosure describes devices, systems, and methods for providing information to sports participants regarding hitting targets, achieving greater accuracy, and improving skill levels. Such information may include, for example, video information, directional information, and/or real-time updated information which may provide feedback to players for improving their skill at one or more tasks that may be performed during competition.

Figure 1:
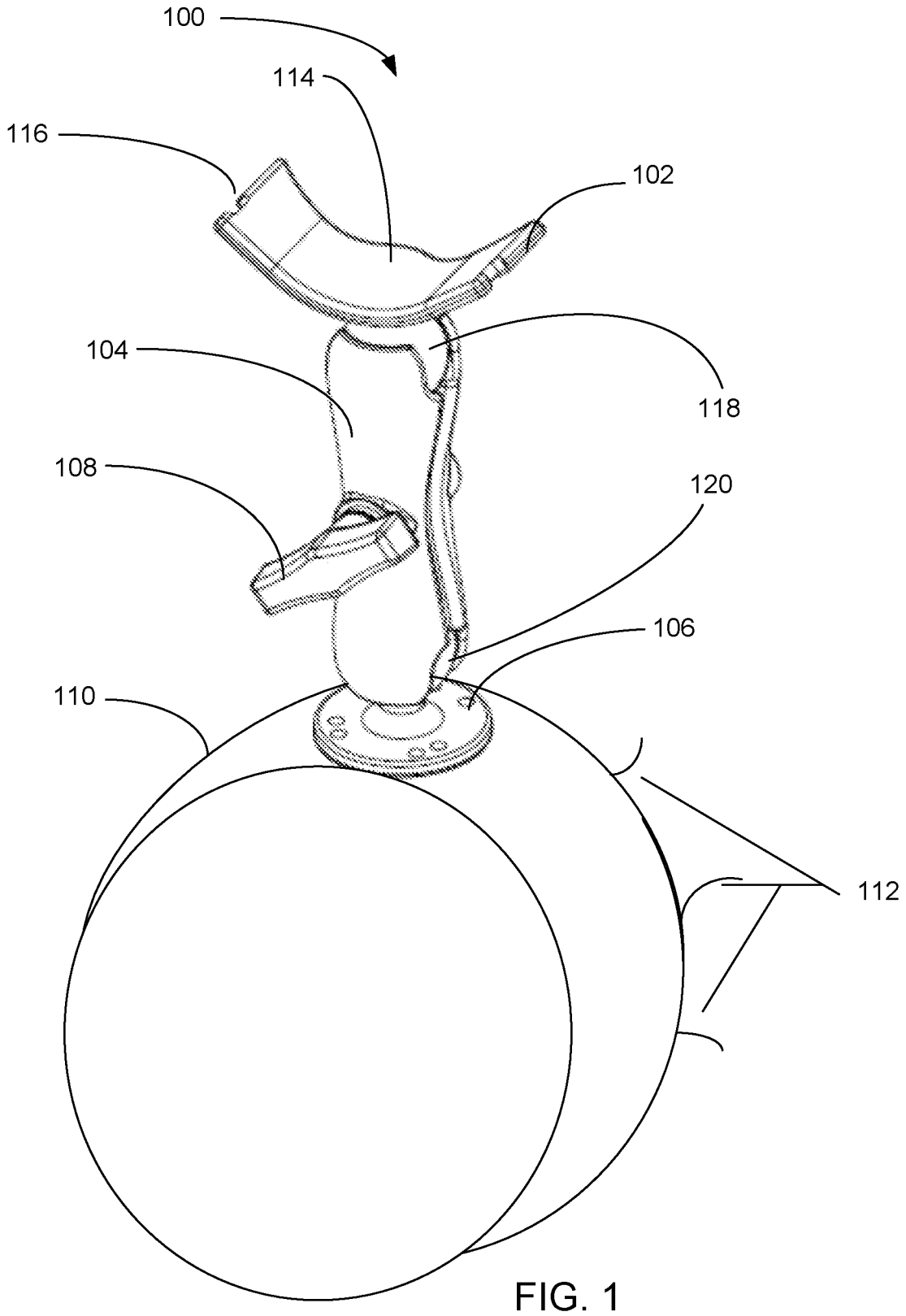
FIG. 1 illustrates an embodiment of a system in accordance with an aspect of the present disclosure.

FIG. 1 illustrates an embodiment of a system in accordance with an aspect of the present disclosure.

As shown in FIG. 1, system 100 may include coupler 102, body 104, target coupler 106, adjusting device 108, and target 110. System 100 may optionally include attachment points 112 if desired. Although system 100 may be described with respect to football (soccer) herein, system 100 may be employed in many sports without departing from the scope of the present disclosure.

Coupler 102 may be employed to attach system 100 to a post or other device for desired placement of system 100. For example, and not by way of limitation, coupler 102 may couple system 100 to a goalframe of a soccer goal, e.g., on the goalpost and/or the crossbar, such that system 100 can be placed in a desired location on the goalframe. Coupler 102 may further comprise a pad 114 on one or more surfaces of coupler 102 to allow for more secure coupling of system 100 to a particular device. For example, and not by way of limitation, pad 114 may be a synthetic and/or natural rubber material, and/or have a roughened surface, such that when system 100 is coupled to a soccer goalframe, the coefficient of friction between system 100 and the soccer goalframe may be increased.

Coupler 102 may also comprise a channel 116, and/or other connection point 116, such that a clamp (e.g., worm drive clamp, compression clamp, etc.), and/or other device can be fixedly and/or removably attached to coupler 102. For example, and not by way of limitation, a latching device may be coupled to coupler 102 to compress pad 114 (if present on coupler 102) against a surface of the soccer goalframe such that coupler 102 is substantially immobile once the latching device is tightened around the goalframe and coupler 102. Many different possibilities for attachment at connection point 116, and/or other connection means between a device and coupler 102, are possible within the scope of the present disclosure.

Body 104 comprises one or more portions to connect joint 118 of coupler 102 to other portions of system 100. Although joint 118 is shown as a ball joint, other types of connections between body 104 and coupler 102 are envisioned as being within the scope of the present disclosure.

Target coupler 106 is coupled to body 104 via joint 120. Although joint 120 is shown as a ball joint, other types of connections between body 104 and target coupler 106 are envisioned as being within the scope of the present disclosure. Target coupler 106 connects body 104 to target 110. For example, and not by way of limitation, target coupler 106 may comprise a spring and/or hinge between target coupler 106 and joint 120 to allow target 110 to be struck by a ball, errant shot, etc., and allow target 110 to deflect from a nominal position of target 110 and/or return to a nominal position of target 110. Further, such a coupling may allow for target 110 to be hit by a ball or other object as part of a game or competition, which may provide additional training skills for users.

Adjusting device 108 allows for angular adjustment between coupler 102 and target coupler 106, as well as adjustment of the immobility of coupler 102 and/or target coupler 106. For example, and not by way of limitation, it may be desired that target 110 be at a desired angle with respect to the soccer goalframe. By coupling coupler 102 to the soccer goalframe, adjusting device 108 allows the portions of body 104 to separate and/or be brought together via compression such that the angle between the joint 118 (and/or the coupler 102) and joint 120 (and/or the target coupler 106) can be adjusted as desired. Changing the tension applied by adjusting device 108 can then render this angle as more and/or less immobile. For example, and not by way of limitation, tightening adjusting device 108 would provide additional compression between the portions of body 104, and thus more compression around joints 118 and 120. As the compression increases on joints 118 and 120, the ability for movement of body 104, and the angle between body 104 and each of joints 118 and 120, would be reduced. Loosening adjusting device 108 would produce the opposite effect, i.e., the ability for movement of body 104 and the angle between body 104 and each of joints 118 and 120 would be increased.

Although shown as a thumbscrew in FIG. 1, adjusting device 108 may be any sort of adjusting device, e.g., cam lock, clamp, worm drive, etc. without departing from the scope of the present disclosure.

Target 110 may be of any shape desired to allow for a player to practice the drills desired. For example, and not by way of limitation, a player practicing baseball pitching may wish to have target 110 be square and/or rectangular in shape, to indicate the approximate shape of the strike zone in baseball. In soccer, the shape of the target 110 may be circular, but may also be triangular, oval, etc., depending on the target area that is desired for a given skill practice. Further, target 110 may include visual and/or audio aids, e.g., colors, lighting such as Electroluminescence wire (EL wire) lighting, light emitting diode (LED) lighting, metronome or other sound emitting devices, and/or other visual/audio cues to provide users with aiming and/or targeting aids.

System 100 may optionally include attachment points 112 if desired. For example, and not by way of limitation, attachment points 112 may be used to attach a net or other device to target 110 such that balls that are "on target" are captured in the net attached to attachment points 112, while balls that are "off target" would not be captured in the net attached to attachment points 112.

Figure 2:
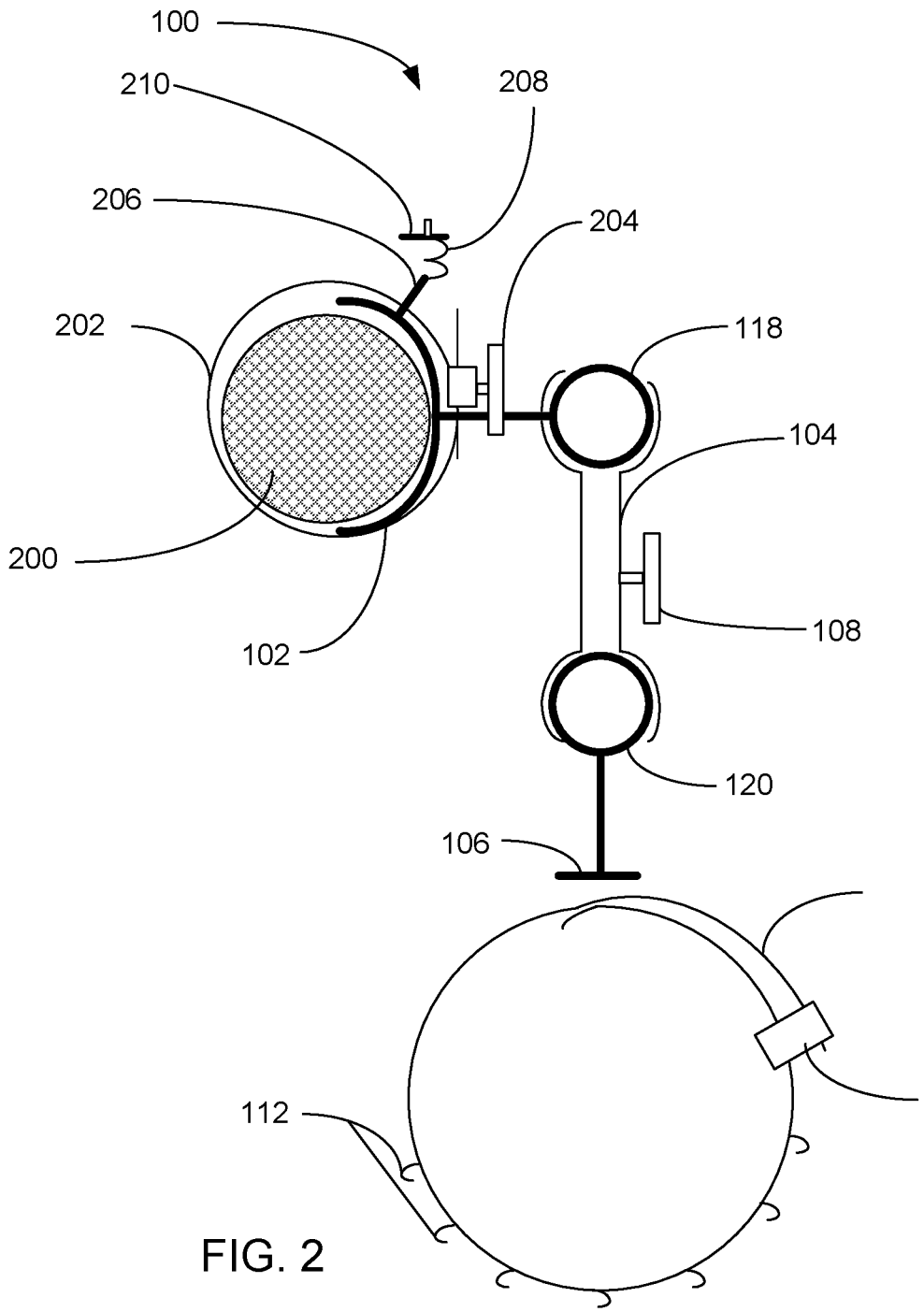
FIG. 2 illustrates a side view of an embodiment of a system in accordance with an aspect of the present disclosure.

FIG. 2 illustrates a side view of an embodiment of a system in accordance with an aspect of the present disclosure.

As shown in FIG. 2, system 100 couples target 110 to goalframe 200 with clamp 202 by compression of coupler 102 against goalframe 200. Clamp 202 may be a worm gear clamp, or may be a quick-release clamp using cams, gears, and/or other mechanisms to allow for relatively quick clamping and tightening of system 100 to goalframe 200. Mechanism 204 may allow for clamp 202 to be attached to and/or tightened around goalframe 200, which may compress coupler 102 against goalframe 200.

Optionally, attachment 206 may be coupled to system 100 (shown as attached to coupler 102, but may be coupled anywhere on system 100) to allow for attaching additional items to system 100. For example, and not by way of limitation, a video camera (such as a GoPro.RTM. camera), a cellular telephone, a Bluetooth device, and/or other devices may be coupled to system 100 for recording of practice sessions and/or other reasons. Further, attachment 206 may have a spring 208 or other flexible coupler between attachment 206 and mounting plate 210 to allow the item mounted on attachment 206 to deflect if struck by a ball and/or other object that may strike the item mounted on mounting plate 210.

Target 110 may also be expandable by way of a clamp 212 that may be opened and closed to allow for elongation of target 110. For beginner users, target 110 may be made larger to allow for beginner users to gain confidence in hitting target 110. As a user gains skill in hitting the target 110, target 110 may be reduced in size to make it more difficult for the user to hit target 110. Clamp 212, or other adjustment mechanisms that allow for the elongation/contraction of target 110, make system 110 more versatile and can track the progress of a given user. Markings along target 110 may indicate the circumference, width, length, or other dimensions of target 110, such that a user can repeatably configure system 100 to a given size as desired.

Multi-Sport Use

Figure 3:
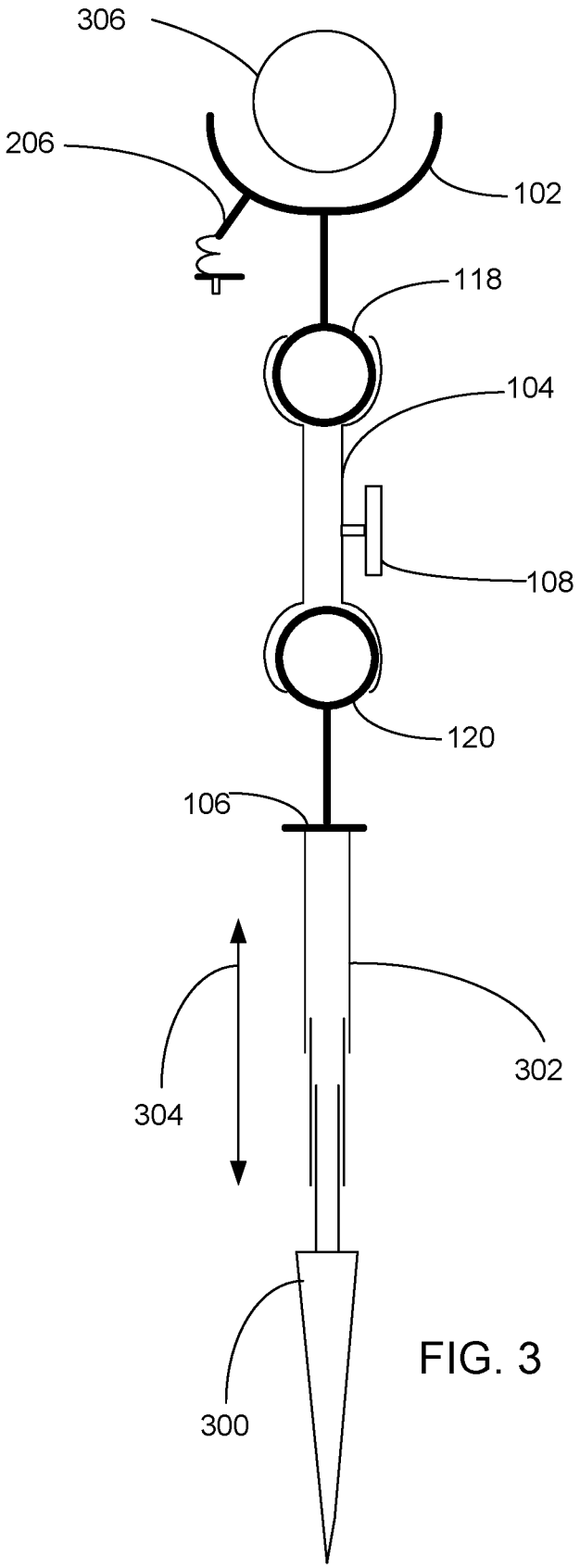
FIG. 3 illustrates a side view of an embodiment of a system in accordance with an aspect of the present disclosure.

FIG. 3 illustrates a side view of an embodiment of a system in accordance with an aspect of the present disclosure.

For use with sports other than soccer, stake 300 with rod 302 may be attached to plate 106 (FIG. 3) to allow system 100 to be coupled to the ground. Rod 302 may be a telescopic rod, and as such may be expandable in direction 304. Rod 302 may also be flexible, e.g., made from a hard rubber substance, etc., such that attempts at hitting target 306 that are misdirected may not damage system 100.

Target 306 may be a strike zone target, a hoop (similar to target 110), or any shaped target that may be sport-specific. For example, a strike zone, that may be expandable in height and width, may be used as target 306 for a baseball pitcher; a larger hoop may be used as target 306 for an American football quarterback as a passing target, etc. It can be seen that coupler 102 can be used to attach system 100 to a stationary object, or coupler 102 can be used to attach system 100 to a target; similarly, coupler 106 can be used to couple system 100 to a target 110 or to an attachment rod 302/stake 300. As such, system 100 can be used in various different ways for different sporting activities without departing from the scope of the present disclosure.

Data Gathering/Processing

Figure 4:
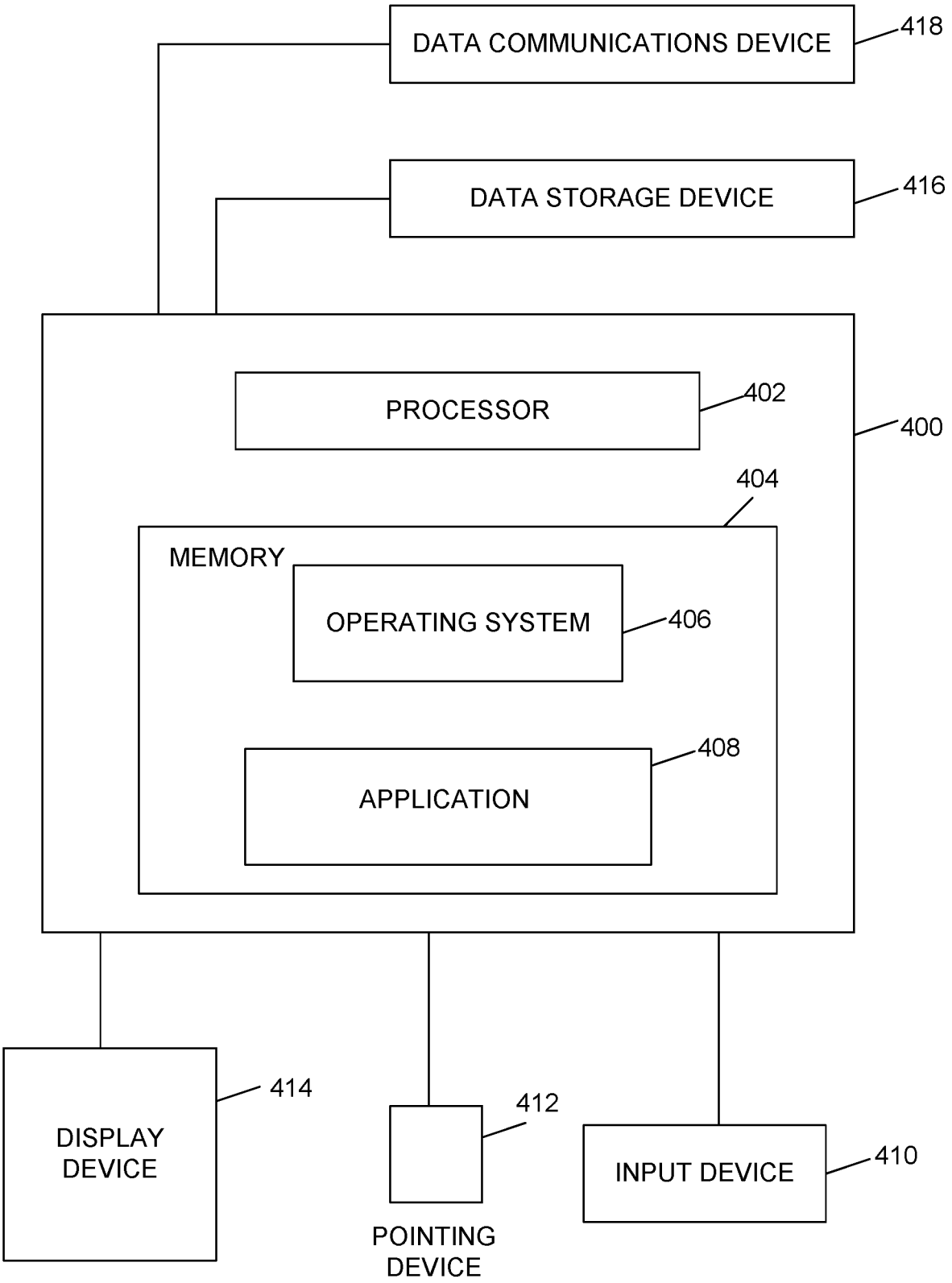
FIG. 4 illustrates a processing system in accordance with an aspect of the present disclosure.

FIG. 4 illustrates a processing system in accordance with an aspect of the present disclosure.

The present disclosure may be implemented using a computer 400, which generally includes, inter alia, a processor 402, random access memory (RAM) 404, data storage devices 416 (e.g., hard, floppy, and/or CD-ROM disk drives, etc.), data communications devices 418 (e.g., modems, network interfaces, etc.), Display device 414 (e.g., CRT, LCD display, touchscreen, etc.), pointing device 412 and input device 410. It is envisioned that attached to the computer 400 may be other devices such as read only memory (ROM), a video card, bus interface, printers, etc. Those skilled in the art will recognize that any combination of the above components, or any number of different components, peripherals, and other devices, may be used with the computer 400.

The computer 400 usually operates under the control of an operating system 406. The present invention is usually implemented in one or more application programs 408 that operate under the control of the operating system 406. The application program 408 may be a program specifically designed to be used with system 100.

Generally, the application program 408 comprises instructions and/or data that are embodied in or retrievable from a computer-readable device, medium, or carrier, e.g., the data storage device 416, a remote device coupled to the computer 400 via the data communications device 418, etc. Moreover, these instructions and/or data, when read, executed, and/or interpreted by the computer 400 cause the computer 400 to perform the steps necessary to implement and/or use the present disclosure.

Thus, the present invention may be implemented as a method, apparatus, or article of manufacture using standard programming and/or engineering techniques to produce software, firmware, hardware, or any combination thereof. The term "article of manufacture" (or alternatively, "computer program product") as used herein is intended to encompass a computer program accessible from any computer-readable device, carrier, or media. Many modifications may be made to this configuration without departing from the scope of the present disclosure.

In an aspect of the present disclosure, device 400 may be attached to system 100, either at mounting plate 208 or in other ways, to record and process data related to the use of system 100. Further, device 400 may assist in the control of the actions of users of system 100, e.g., in terms of number of attempts to make, analysis of the attempts, percentages of targets achieved, etc.

Device 400 may comprise processor 402, memory 404, operating system 406, application 408, input device 410, pointing device 412, display device 414, data storage device 416, and data communication device 418. Processor 402 may receive a signal from one or more input devices 410, e.g., touch screen, sensors attached to targets, etc. Processor 402 may also send inputs and/or outputs and/or other data to data communications device 418 for forwarding to various other devices (e.g., cellular telephones, computers, etc.). Processor 402 may also provide a time stamp, geolocation, and/or other data to indicate data associated with a particular shot, event, etc. recorded by device 400.

A number of systems 400 may be interconnected via data communications device 418 (e.g., the internet, cellular networks, etc.) and/or may be interconnected with other devices to analyze and/or record use of system 400. Display device 414 may also display various video/audio recordings of system 100 in use. Pointing device 412 may be used to navigate through operating system 406/application 408 to allow users to employ different features of device 400, alone or in combination with the use of system 100.

Processor 402 may communicate via data communications device 418 via a wireless and/or hardwired connection including, but not limited to, a Bluetooth connection, an internet connection, a network connection, a cellular connection, and/or any combination thereof As such, device 400, when used in combination with system 100, may provide data recording and analysis of the use of system 100 by a particular user and/or users. Analysis of attempts, percentages, etc., may be analyzed in real time and/or afterwards as a training and/or analysis tool as desired.

Those skilled in the art will recognize that any combination of the above components, or any number of different components, including computer programs, peripherals, and other devices, may be used to implement the present disclosure, so long as similar functions are performed thereby.

In the present disclosure, a processor, microprocessor, and/or computer may be employed in one or more aspects of the disclosure. The use of a processor, microprocessor, and/or computer in and of itself does not render such aspects of the present disclosure as being directed to a judicial exception to patent-eligible subject matter, i.e., a law of nature, a natural phenomenon, or an abstract idea without significantly more. Further, aspects of the present disclosure may claim patent-eligible applications of the concepts of laws of nature, natural phenomena, and abstract ideas.

For example, and not by way of limitation, the present disclosure is directed toward a patent-eligible concept. Aspects and embodiments of the present disclosure, when taken individually and as an ordered combination, are to be considered when determining whether the additional element(s) transform the nature of the claim.

The present application comprises something more than organizing human activity, either through the use of a processor, microprocessor, and/or computer, and/or otherwise, because the processor as employed in the present disclosure does not organize human activity; the processor in aspects of the present disclosure provides data that may be otherwise unavailable to system 100 users, and such that analysis of such data may be undertaken to improve users' skills. Such a result has not been available prior to the present disclosure.

Even if the present disclosure may be directed to a patent-ineligible concept, the elements of the present disclosure, both individually and as an ordered combination, are to be considered to determine whether the additional elements transform the nature of the claim into a patent eligible application. The present disclosure comprises an inventive concept sufficient to ensure that the disclosure in practice amounts to significantly more than a patent upon an ineligible concept. Because the judicial exceptions to patent protection of abstract ideas must be construed carefully, applications of such concepts to a new and useful end remain eligible for patent protection within the present disclosure.

Even if in some instances the present disclosure describes concepts that may be directed to an abstract idea and/or another judicial exception, the present disclosure still describes patentable subject matter that remains eligible for patent protection. For example, and not by way of limitation, the present disclosure does not merely apply applicable laws that are well known in the related art.

Further, the present disclosure describes additional patent-eligible concepts such as a process designed to solve a technological problem in conventional industry practice, and a problem that the industries involved had not been able to obtain previously. Further, the present disclosure is not simply steps previously known and merely implemented on a computer, but feature improvements on an existing technological process. The present disclosure provides solutions and improvements on existing processes that were not previously available.

Because a computer, processor, and/or microprocessor can serve as a patent-eligible structure for a computer-implemented function when the claimed function is coextensive with the microprocessor itself, and a standard microprocessor can serve as sufficient structure for functions that can be achieved by any general purpose computer without special programming, the present invention provides such patent eligibility.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a view of the device as shown in the present disclosure. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, and composition of matter, and means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, and algorithm steps described in connection with the disclosure herein may be implemented as various different types of materials and/or various different combinations of materials. To clearly illustrate this interchangeability, various illustrative components, blocks, modules, and steps have been described above generally in terms of their functionality. The various materials and/or combinations of materials employed to implement the present disclosure depends upon the particular application and design constraints imposed on the overall system. Skilled artisans may implement the described functionality in varying ways for each particular application, but such implementation decisions should not be interpreted as causing a departure from the scope of the present disclosure.

Figure 5:
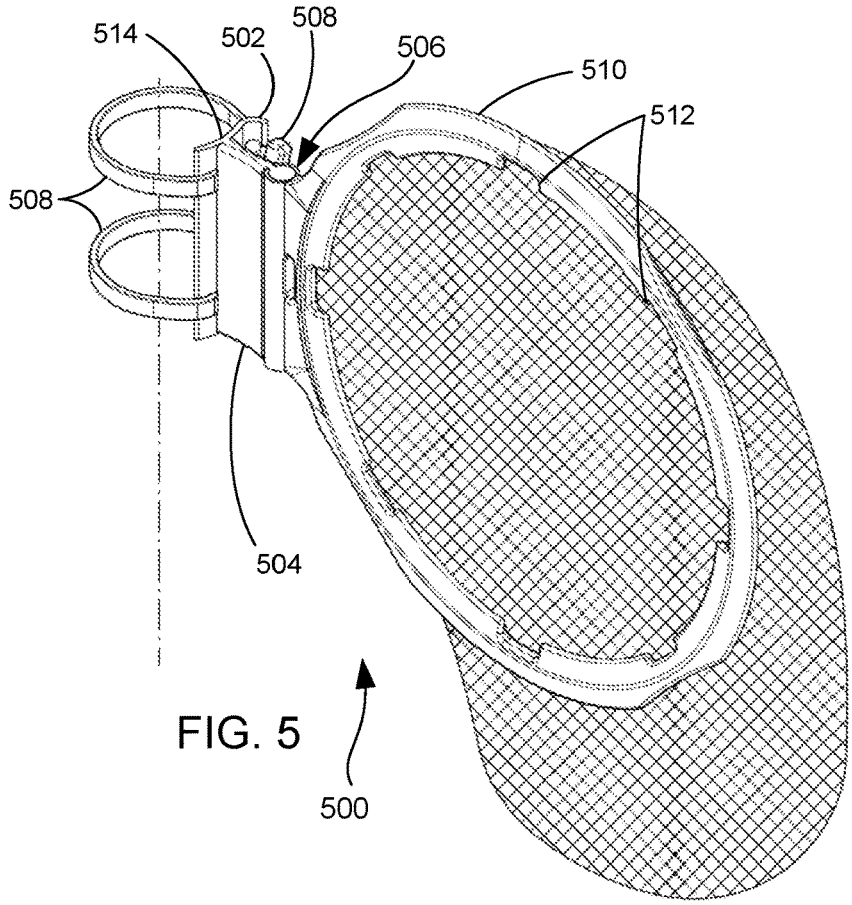
FIG. 5 depicts an elevated isometric front view of another variation of the system of the preceding figures.
Figure 6:
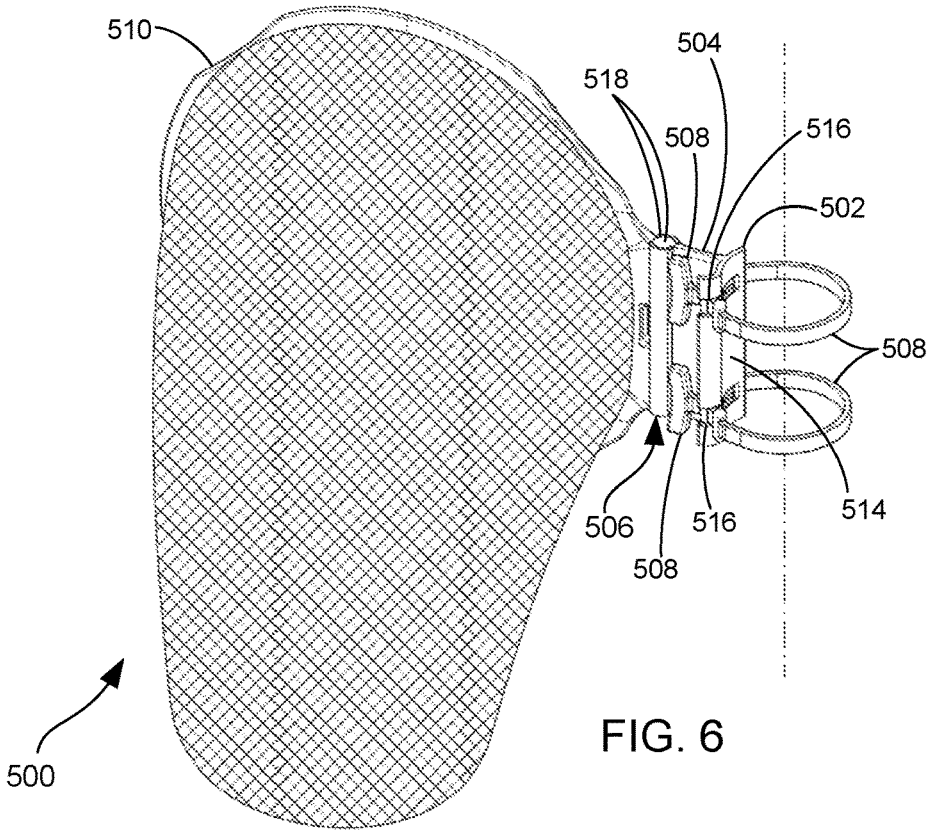
FIG. 6 is directed to an elevated isometric rear view of the variation of the system of FIG. 5.
Figure 7:
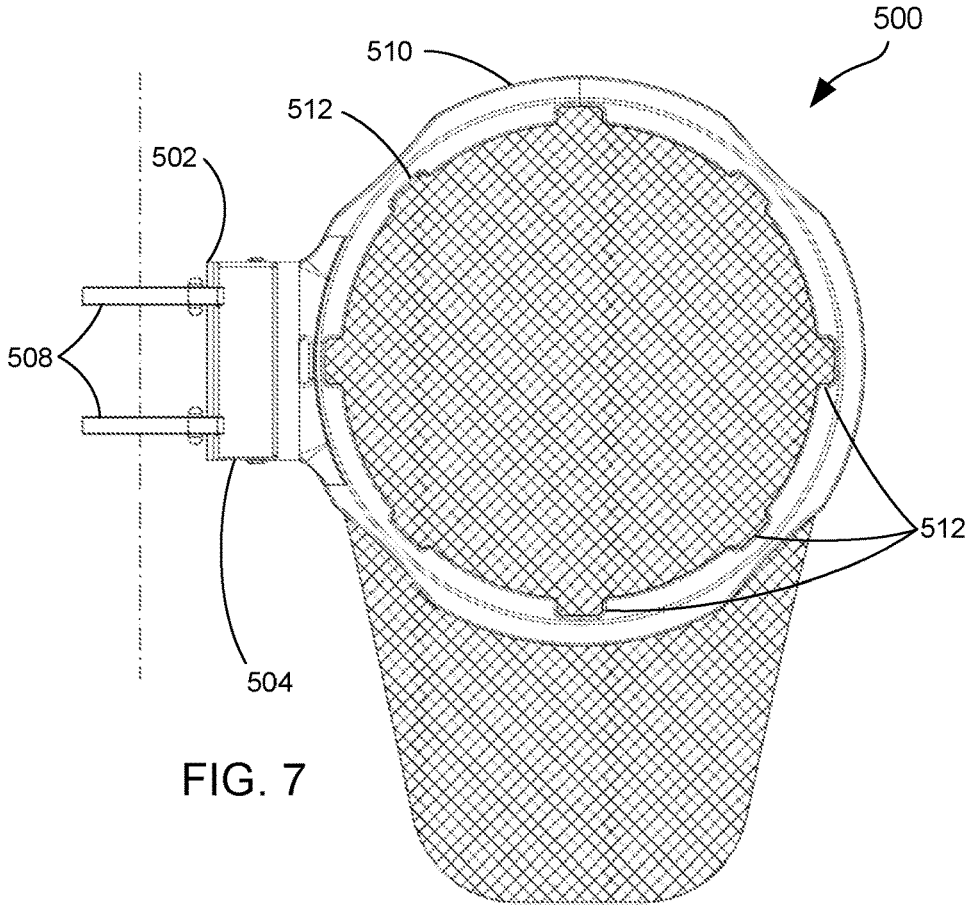
FIG. 7 is a front plan view of the variation of FIGS. 5-6.
Figure 8:
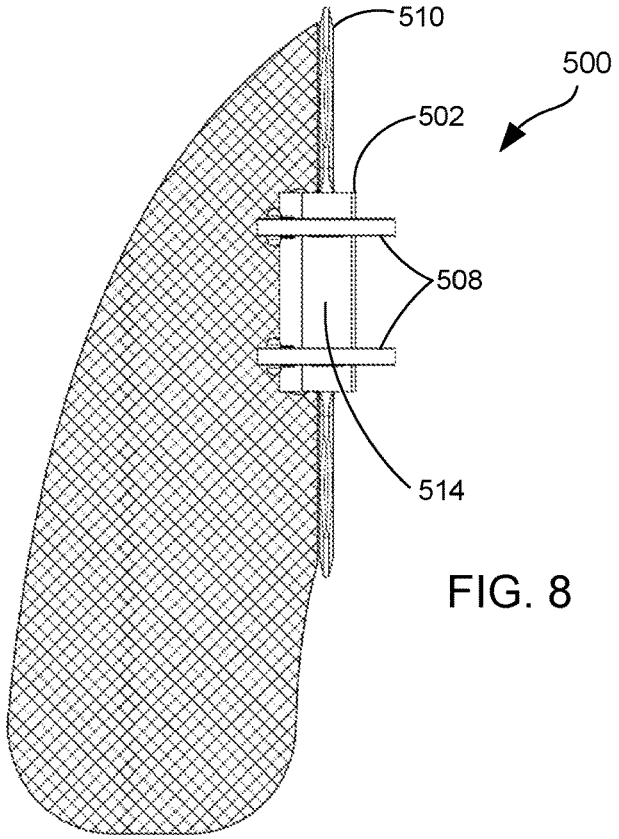
FIG. 8 is a side plan view of the variation of FIGS. 5-7.
Figure 9:
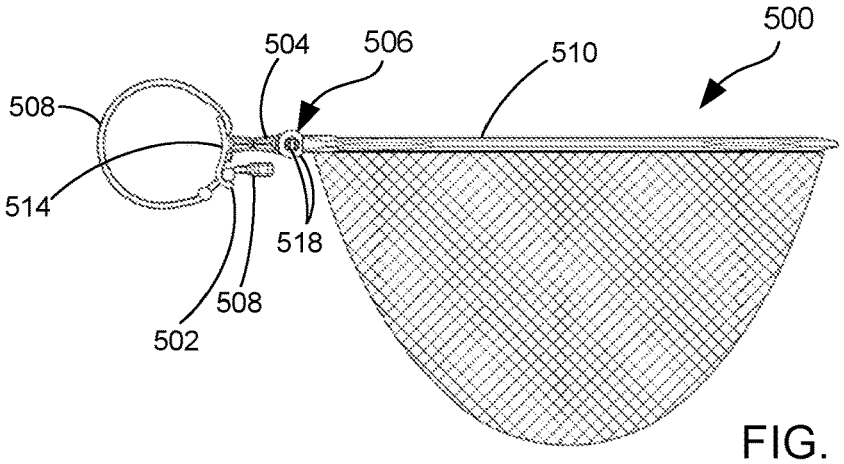
FIG. 9 is a top plan view of the variation of FIGS. 5-8.
Figure 10:
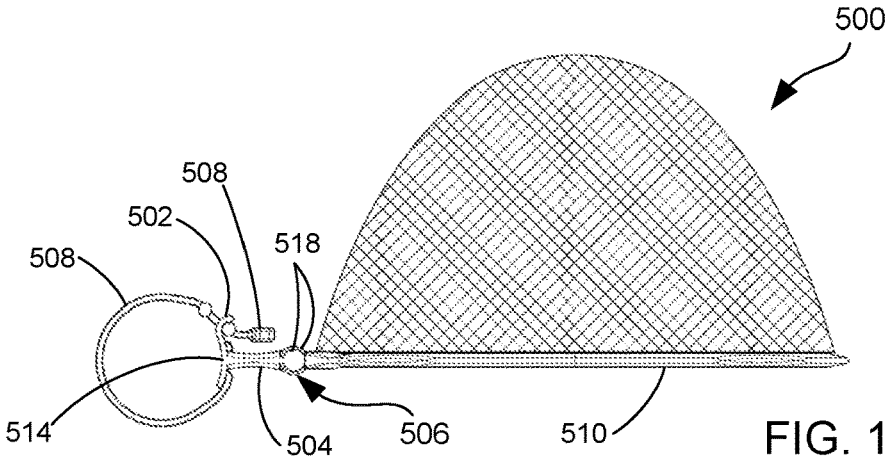
FIG. 10 is a bottom plan view of the variation of FIGS. 5-9.
Figure 11:
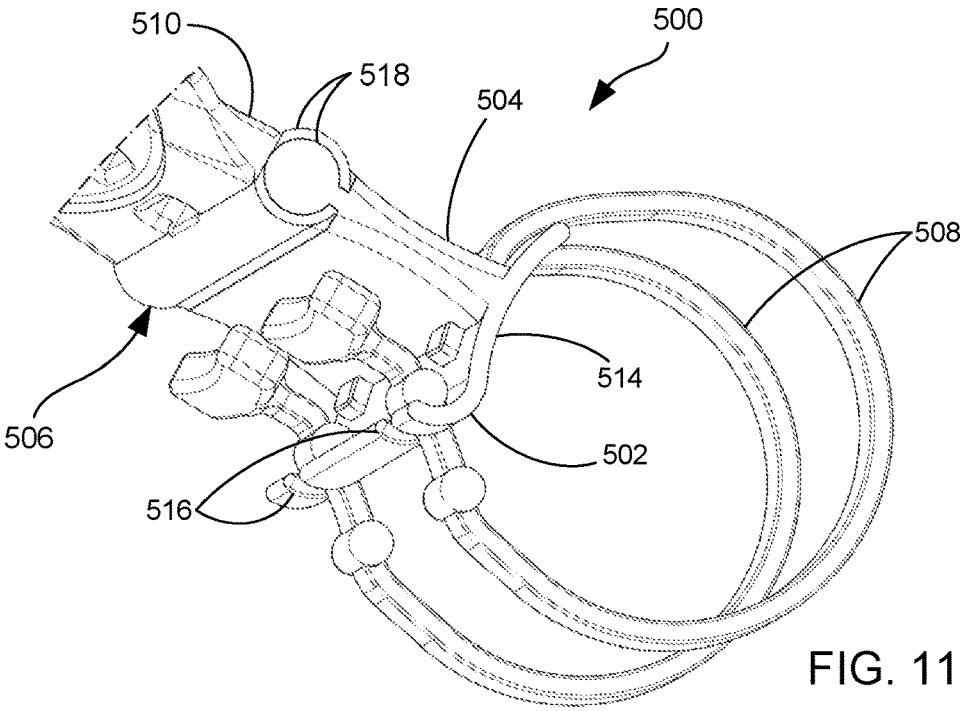
FIG. 11 is an enlarged partial view of components of the variation of FIGS. 5-10.

FIGS. 5 and 6 illustrate another variation of the preceding configurations, and include system 500 again including a coupler 502, body 504, target coupler 506, adjusting device 508, and target 510. System 500 optionally may also include attachment points 512 for target 510 to attach a net or other element. In optionally preferred arrangements, the adjusting device 508 may formed as at least one strap integrally formed with goal frame coupler 502 and/or about one of the opposing ends of body 504. The strap-type configuration may further optionally incorporate a knob or one or more spaced apart knobs that cooperate with other components to enable adjustment, and to enable fastening of system 500 to poles or other sporting equipment. Although this variation of system 500 is configured differently, as before, here too it may be described to being useful in practicing football (soccer), as well as many other sports.

Coupler 502 may be employed to attach system 500 to a post or other device for desired placement of system 500. Such contemplated posts or other devices are schematically represented in these related figures as dashed or chain lines. For example, similar to other variations, coupler 502 may couple system 500 to a goalframe of a soccer goal, e.g., on the goalpost and/or the crossbar, such that system 500 can be placed in any preferred location on the goalframe. Coupler 502 may further comprise a pad 514 on one or more surfaces of coupler 502, similarly constructed as in prior configurations, to enable improved and secure coupling of system 500 to a particular device such as a goalframe.

Coupler 502 may also be formed and/or define a channel 516, and/or other connection point, such that adjusting device 508, such as the at least one strap and integral knob configuration of FIGS. 5—is/are received therein to fixedly and/or removably attach to coupler 502. As with preceding arrangements, here adjusting device 508 may incorporate or be formed as straps that incorporate adjustment features, such as for example without limitation integrally formed adjustment knobs, which when received in channels 516, in turn couple or fasten coupler 502 about a sporting device pole, and to compress pad 514 if utilized, against the soccer goalframe. In this arrangement, coupler 502 is substantially immobile once strap-type adjusting device 508 is tightened around a pole or other component of the goalframe and a knob of the strap is captured within channel 516 of coupler 502. As with the various other configurations of the disclosure, many arrangements for attachment of adjusting device 508 about connection point 518 with target 110, as well as between coupler 502 and a goalframe or other sports device, are possible within the scope of the present disclosure.

As with other arrangements, here body 504 incorporates or is formed with one or more portions to connect joint 518 to other portions of system 500, such as target 510. In this current adaptation, joint 518 is shown as generally round or cylindrical slotted received that is received with a round pin that is formed about the body 504. However, other types of connections between body 504 and other components of system 500 are contemplated to be within the scope of the present disclosure and the accompanying claims.

Target coupler 506 connects body 504 to target 510. For example, and not by way of limitation, body 504 may comprise a spring, as described elsewhere herein, formed by a flexible polymeric material or materials, which extend between target coupler 506 and joint 518. In this configuration, target 510 may be struck by a ball or other game piece, and enable target 510 to deflect from and/or return to a nominal position of target 510, as with previous combinations.

As before, adjusting device 508 also enables angular adjustment between coupler 502 and a soccer or football goalframe or other sports device. Similar to previously described arrangements, for example without limitation, target 510 may be positioned at a desired angle with respect to the soccer goalframe. By coupling coupler 502 to the soccer goalframe, adjusting device 508 allows the portions of body 504 to be adjusted relative thereto. Further, changing or adjusting the tension applied by the strap-type adjusting device 508 can fix any such relative positioning. Although shown in system 500 as a strap-type configuration in the related FIGS. 5-10, wherein adjusting device 508 incorporated integral knobs formed about the elongated straps, many other suitable adjusting devices are also contemplated herein. The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

I claim:

1. A targeting device, comprising:

a body (504) formed from a flexible polymeric material to have opposing sides with at least one side establishing a target coupler (506) about the body (504);

a goal frame coupler (502) carried by the body (504) formed with a surface received with a friction pad (514);

at least one strap-type adjusting device (508) formed with one or more knobs, and depending from the goal frame coupler proximate one of the opposing sides of the body;

at least one respective channel (516) formed in the coupler (502) and sized to capture one of the one or more knobs;

the target coupler (506) formed by a connection joint (518) that incorporates a cylindrical receiver which receives a pin formed about the body (504) to establish the connection joint;

wherein the adjusting device is coupled to the body and during operation when loosened to a predetermined variable tension, enables angular rotation about an axis of rotation, and when tightened, restricts rotation to a variable tension higher than the predetermined variable tension; and a target (510) coupled to the target coupler (506) about the connection joint (518).

2. The targeting device of claim 1, further comprising the target (510) being a net sized to capture a game piece.

3. The targeting device of claim 1, in which the adjustment device (508), friction pad (514), and at least one coupler channel (516) are configured to cooperate to enable coupling to a goalframe.

4. The targeting device of claim 1, in which the adjusting device is configured when tightened to establish a fixed orientation between a goalframe and the target coupler.

5. The targeting device of claim 4, further comprising the target defining an interior through hole and incorporating attachment points configured to receive and carry a net about the target and sized to capture a game piece.

6. The targeting device of claim 5, further comprising at least one visual aid coupled to the target.

7. The targeting device of claim 6, further comprising at least one sensor, coupled to the target, configured to determine accuracy of an attempt to hit the target.

8. The targeting device of claim 7, further comprising a processor including a memory configured to store an operating system and an application, an input device, a display device, a data communications device, and a storage device, coupled to the at least one sensor, which are configured to record and communicate signals from the at least one sensor.

9. The targeting device of claim 8, wherein the data communication device is communicatively coupled to a cellular telephone system.

10. The targeting device of claim 8, further comprising an attachment having a mounting plate coupled thereto with a flexible coupler, and wherein the at least one sensor comprises a camera configured to be received by the mounting plate.

11. A targeting device, comprising:

a body (504) formed from a flexible polymeric material to have opposing sides with at least one side establishing a target coupler (506) about the body (504);

a goal frame coupler (502) carried by the body (504) formed with a surface received with a friction pad (514);

at least one strap-type adjusting device (508) formed with at least one knob, and depending from the goal frame coupler;

at least one respective channel (516) formed in the coupler (502) and sized to capture one of the one or more knobs;

the target coupler (506) formed by a connection joint (518) that incorporates a cylindrical receiver which receives a pin formed about the body (504) to establish the connection joint;

an adjusting device (508) coupled to the body and configured when loosened to a predetermined variable tension to enable angular rotation about an axis of rotation, and to restrict rotation when tightened to a variable tension higher than the predetermined variable tension;

wherein the adjusting device (508), friction pad (514), and at least one coupler channel (516) are configured to cooperate to enable coupling to a goalframe;

wherein the adjusting device is configured when tightened to establish a fixed orientation between a goalframe and the target coupler; and a target (510) coupled to the target coupler (506) about the connection joint (518).

12. The targeting device of claim 11, further comprising the target (510) being a net sized to capture a game piece.

13. The targeting device of claim 11, further comprising the target defining an interior through hole and incorporating attachment points configured to receive and carry a net about the target and sized to capture a game piece.

14. The targeting device of claim 11, further comprising at least one visual aid coupled to the target.

15. The targeting device of claim 11, further comprising at least one sensor, coupled to the target, configured to determine accuracy of an attempt to hit the target.

16. The targeting device of claim 15, further comprising a processor including a memory configured to store an operating system and an application, an input device, a display device, a data communications device, and a storage device, coupled to the at least one sensor, which are configured to record and communicate signals from the at least one sensor.

17. The targeting device of claim 16, wherein the at least one sensor comprises a camera configured to be received by the body.

18. A targeting device, comprising:

a body (504) formed from a flexible polymeric material to have opposing sides with at least one side establishing a target coupler (506) about the body (504);

a goal frame coupler (502) carried by the body (504) formed with a surface received with a friction pad (514);

at least one strap-type adjusting device (508) formed with one or more spaced apart knobs, and extending from goal frame coupler;

at least one respective channel (516) formed in the coupler (502) and sized to capture one or more of the one or more knobs;

the target coupler (506) formed by a connection joint (518) that incorporates a cylindrical receiver which receives a pin formed about the body (504) to establish the connection joint;

an adjusting device (508) coupled to the body and configured when loosened to a predetermined variable tension to enable angular rotation about an axis of rotation, and to restrict rotation when tightened to a variable tension higher than the predetermined variable tension;

wherein the adjusting device (508), friction pad (514), and at least one coupler channel (516) are configured to cooperate to enable coupling to a goalframe;

wherein the adjusting device is configured when tightened to establish a fixed orientation between a goalframe and the target coupler;

a target (510) coupled to the target coupler (506) about the connection joint (518); and wherein the target defines an interior through hole and incorporates attachment points configured to receive an added element, and sized to capture a game piece.

19. The targeting device of claim 18, further comprising the target (510) incorporating a net sized to capture a game piece.

20. The targeting device of claim 18, further comprising a processor including a memory configured to store an operating system and an application, an input device, a display device, a data communications device, and a storage device, coupled to at least one sensor, which are configured to record and communicate signals from the at least one sensor; and wherein the at least one sensor is coupled to the target and configured to determine accuracy of an attempt to hit the target.

* * * * *